US005162695A

United States Patent [19]

Shimona et al.

[11] Patent Number: 5,162,695

[45] Date of Patent: Nov. 10, 1992

[54] ELECTRON GUN ASSEMBLY FOR A COLOR CATHODE RAY TUBE

[75] Inventors: Taketoshi Shimona, Isesaki; Eiji Kamohara, Fukaya; Shigeru Sugawara, Fukaya; Jiro Shimokobe, Fukaya, all of Japan

[73] Assignee: Kabushiki Kaisha Toshiba, Kawasaki, Japan

[21] Appl. No.: 707,923

[22] Filed: May 28, 1991

Related U.S. Application Data

[63] Continuation of Ser. No. 340,738, Apr. 20, 1989, abandoned.

[30] Foreign Application Priority Data

Apr. 20, 1988 [JP] Japan ..... 63-95411
Aug. 8, 1988 [JP] Japan ..... 63-196085

[51] Int. Cl.[5] ..... H01J 29/48
[52] U.S. Cl. ..... 313/412; 313/414
[58] Field of Search ..... 313/412, 413, 414

[56] References Cited

U.S. PATENT DOCUMENTS 4,528,476 7/1985 Alig ..... 313/412
4,772,827 9/1988 Osakabe ..... 313/414 X

FOREIGN PATENT DOCUMENTS 53-69 1/1978 Japan .

*Primary Examiner*—Sandra L. O'Shea
*Attorney, Agent, or Firm*—Cushman, Darby & Cushman

[57] ABSTRACT

In a electron gun assembly, three in-line electron beams are generated from three cathodes and are controlled and accelerated by a prefocusing electron lens, and each of the electron beams is converged by unipotential electron lens. In a horizontal plane, the electron beams are collimated by a quadruple lenses and are incident on a single and common large-diameter main electron lens. In a vertical plane, each of the electron beams is emerged as a divergent electron beam from the quadruple lens and each of the divergent electron beams is incident on the main electron lens. Thus, each of the electron beams are correctly focused on a screen and the three electron beams are correctly converged on a convergent point by the main electrode lens.

16 Claims, 11 Drawing Sheets

ELECTRON GUN ASSEMBLY FOR A COLOR CATHODE RAY TUBE

This is a continuation of application Ser. No. 07/340,738, filed on Apr. 20, 1989, which was abandoned upon the filing hereof.

BACKGROUND OF THE INVENTION

1. Field of the Invention

This invention relates to a color cathode ray tube and more particularly to a color cathode ray tube having an electron gun assembly for focusing and converging three electron beams arranged in line using a single large-diameter electron lens.

2. Description of the Related Art

In ordinary color cathode ray tubes, screen 2 is formed on faceplate 3 of an envelope as shown in FIG. 1. Skirt 3*a* of a rectangular panel including faceplate 3 is connected via funnel 4 to neck 5 in which electron gun assembly 6 is received. Deflection unit 7 is disposed around the outer surface of the funnel 4 and neck 5. Shadow mask 9 having a plurality of apertures 8 is arranged to face screen 2 with a gap therebetween. Inner conductive film 10 is applied uniformly from the inside wall of funnel 4 to a part of neck 5. Outer conductive film 11 is applied to the outer surface of funnel 4. An anode terminal (not shown) is provided on the funnel 4.

Phosphor stripes or dots are formed on the face plate 3 to form a phosphor screen 2. When the three electron guns beams BR, BG and BB emitted from the electron pass through shadow mask 9 and land guns on the corresponding phosphor spots, the electron-bombarded spots of the phosphor layers emit red, green and blue light rays.

Electron gun assembly 6 includes an electron beam generator GE for generating, accelerating and controlling in-line beams BR, BG and BB and main electron lens section ML for focusing and converging these electron beams. The electron beams BG, BR and BB generated from the electron gun assembly are deflected by deflection unit 7 to scan the whole area of the screen, thereby forming a raster on the screen.

U.S. Pat. No. 2,957,106 discloses an electron gun assembly for converging the three beams on the screen in which the side beams of the three beams are inclined with respect to the center beam and are crossed with the center beam. In addition, U.S. Pat. No. 3,772,554 discloses an electron gun assembly for converging the electron beams in which side apertures are formed on an electrode through which the side beams pass as to have a center which are slightly shifted outwardly from the center axis of the corresponding side electron gun. Thus, the electron beams passing through the side apertures are converged on the screen. Both of these techniques have been adopted extensively in color cathode ray tubes. The deflection unit includes a horizontal deflection coil for generating a horizontal deflection magnetic field to deflect the electron beams in a horizontal direction and a vertical deflection coil for generating a vertical reflection magnetic field to deflect the electron beams in a vertical direction. In the color cathode ray tubes, when the electron beams are deflected, the deflection force causes the three electron beams not to be converged correctly. For this reason, self-convergence magnetic fields are formed, in which the horizontal deflection magnetic field is a pincushioning type and the vertical deflection magnetic field is a barrel type. Also, a convergent free system has been adopted in which the three electron beams can be converged ear the whole area of the phosphor screen.

As mentioned above, the quality of color cathode ray tubes has been improved by the adoption of many newly-developed techniques. However, as larger and higher-grade tubes are manufactured, new problems have arisen. Among these problems is a problem of whether the electron beam spot is formed on the screen with a sufficiently small diameter, a problem of the distortion of the electron beam spots at the peripheral portion of the screen when a beam is deflected thereto and a problem of whether a correct convergence can be achieved in the whole area of the screen. As the cathode ray tube becomes large in size, the distance from the electron gun to the screen becomes longer, the electro-optical magnification of the electron lens becomes large, the beam spot diameter on the screen becomes large, thereby degrading video resolution. To solve this problem, it is necessary to improve the performance of the electron lens of the electron gun so that the beam spot on the screen is made smaller in diameter.

Generally, in the main electron lens section, a plurality of electrodes having openings are arranged along an axis and specified potentials are applied respectively to the plurality of electrodes. There are different types of electrostatic lenses based on different types of electrode construction. To be sure, the lens performance can be improved basically either b forming a large-diameter lens with a large electrode aperture or by forming a long focal-distance lens with gradual changes in potential by increasing the distances between the electrodes. However, since the electron gun of a color cathode ray tube is received in the neck portion, which is generally a thin glass cylinder, the electrode aperture or the lens diameter is limited physically. Further, the distances between the electrodes are limited to prevent the electric field formed between the electrodes from being affected by other undesirable electric fields in the neck.

In the color cathode ray tubes such as shadow mask type in which three electron guns are arranged in a delta or in-line, as described above, as the electron beam spacing Sg is made smaller, the three electron beams can be converged more easily at one point near the whole area of the screen and less electric power is required for deflection. However, in order for the electron guns to be more closely arranged, the electrode aperture has to be decreased.

Therefore, a technical solution is conceivable in which the co-planer three electron lenses are combined to form a large electron lens so that the performance of the large-diameter electron lens can be fully exercised. FIG. 2 illustrates the large-diameter electron lens. As is clear from FIG. 2, the cores of the electron beams formed on the screen are reduced but they do not have correct shapes. In other words, when the three parallel electron beams BR, BG and BB pass through a common large-diameter lens LEL, if the center beam BG is correctly converged as in FIG. 2, the outer beams BR and BB will be overfocused and overconverged and the beam, spots with a large comatic aberration will be formed on the screen. That is to say, the three beam spots SP, SP and SP will be formed on the screen greatly spaced apart from one another and the outer beam spots will be distorted.

In order to match all converged conditions of the three electron beams and reduce the comatic aberration, the mutual spacing Sg of the three beams with respect to the lens diameter D of the electron lens LEL needs to be decreased to some extent. With regard to the focused conditions of the three beams on the screen, it is necessary to minimize the Sg, but there is a limitation to this approach because of the mechanical arrangement of the electron beam generator section.

Japanese Patent Publication No. 49-5591 (U.S. Pat. No. 3,448,316) and U.S. Pat. No. 4,528,476 disclose that. of the three electron beams incident on the electron lens LEL, the side electron beams are inclined by the angle $\theta 0$ with respect to the center electron beam as shown in FIG. 3, and the three beams pass through the central part of the electron lens LEL at the same time. In this way, all converged conditions of the three beams are matched. The two side beams passing in the directions coming away from the center electron beam emerging from the electron lens LEL are deflected forcibly by the second lens LEL2 by the angle $\phi$ in the opposite directions. Therefore, the three beams are converged near the screen. Thus, the convergence and the focusing of the three beams are improved. However, there still remains a problem that a great deflection aberration or comatic aberration occurs in the two outer beams.

As described above, it is difficult, by the conventional techniques, to form a large-diameter electron lens that works equally on the three electron beams and utilizes the performance of large-diameter electron lenses to the fullest.

As we have seen, in order to further improve the picture image performance of color cathode ray tubes, it is effective to improve the performance of the electron gun by using a large-diameter electron lens common to the three electron beams. The conventional techniques, however, have their limitations in that they do not allow optional function of large-diameter electron lenses and are not useful in further improving the picture image performance of color cathode ray tube apparatuses. Therefore, to further enhance the performance of the picture image of color cathode ray tubes, it is desirable to develop a color cathode ray tube having an electron gun, capable of allowing a large-diameter electron lens to function optionally.

SUMMARY OF THE INVENTION

The object of this invention is to provide a cathode ray tube apparatus comprising:

an electron gun assembly including:

generating means for generating three in-line electron beams on a horizontal plane and controlling and accelerating the electron beams; and a single main electron lens system for focusing and converging the three electron beams from the generating means, said main electron lens system comprising a single and common large-diameter asymmetric electron lens having different electron lens power in the horizontal and vertical directions, the three electron beams incident on the main electron lens, with each beam more diverged in the vertical plane than in the horizontal plane, and with each beam parallel to other beams in the horizontal plane.

According to this invention, there is also provided a cathode ray tube apparatus comprising:

an electron gun assembly including:

generating means for generating three in-line electron beams with two outside beams and a center beam, in a horizontal direction, and for controlling and accelerating the electron beams; and a main electron lens system for focusing and converging the three electron beams from said generating means, said electron lens comprising: a first hollow cylindrical electrode structure having, on one end, an end electrode with apertures, and, on the other end, a first plate electrode with a non-circular hole with a major axis extending along the horizontal plane perpendicular to the center electron beam; a second hollow cylindrical electrode structure, in which a part of the first hollow cylindrical electrode structure is inserted and in which a second plate electrode, with a non-circular electrode with a major axis along a vertical direction is placed; and voltage potentials on cylindrical electrode structures such that the first cylindrical electrode structure is at a lower potential than the second cylindrical electrode structure.

DETAILED DESCRIPTION OF THE PREFERRED EMBODIMENTS

Figure 4:
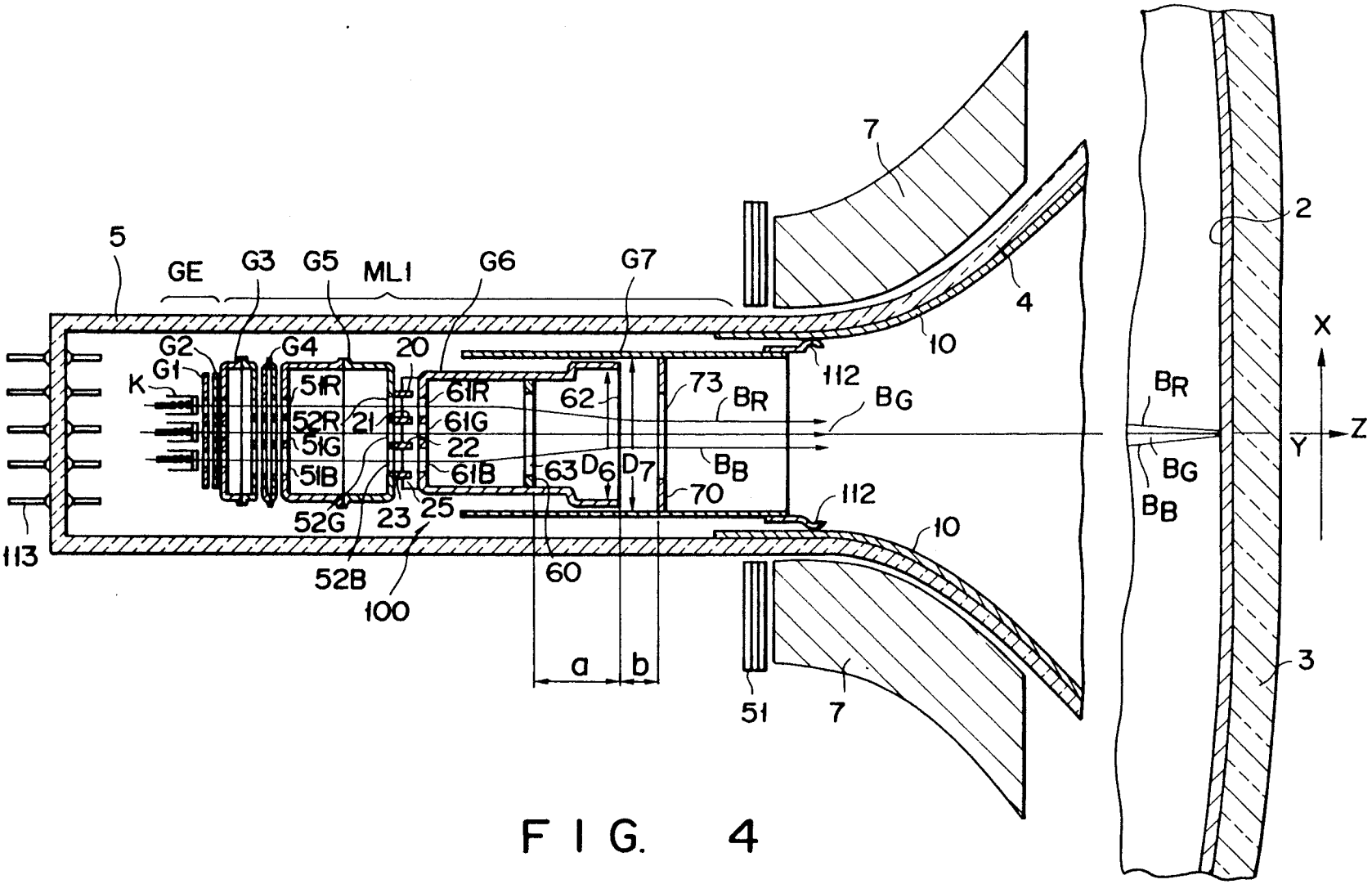
FIG. 4 is an X-Z sectional view schematically showing a part of the color cathode ray tube apparatus according to an embodiment of this invention.
Figure 5:
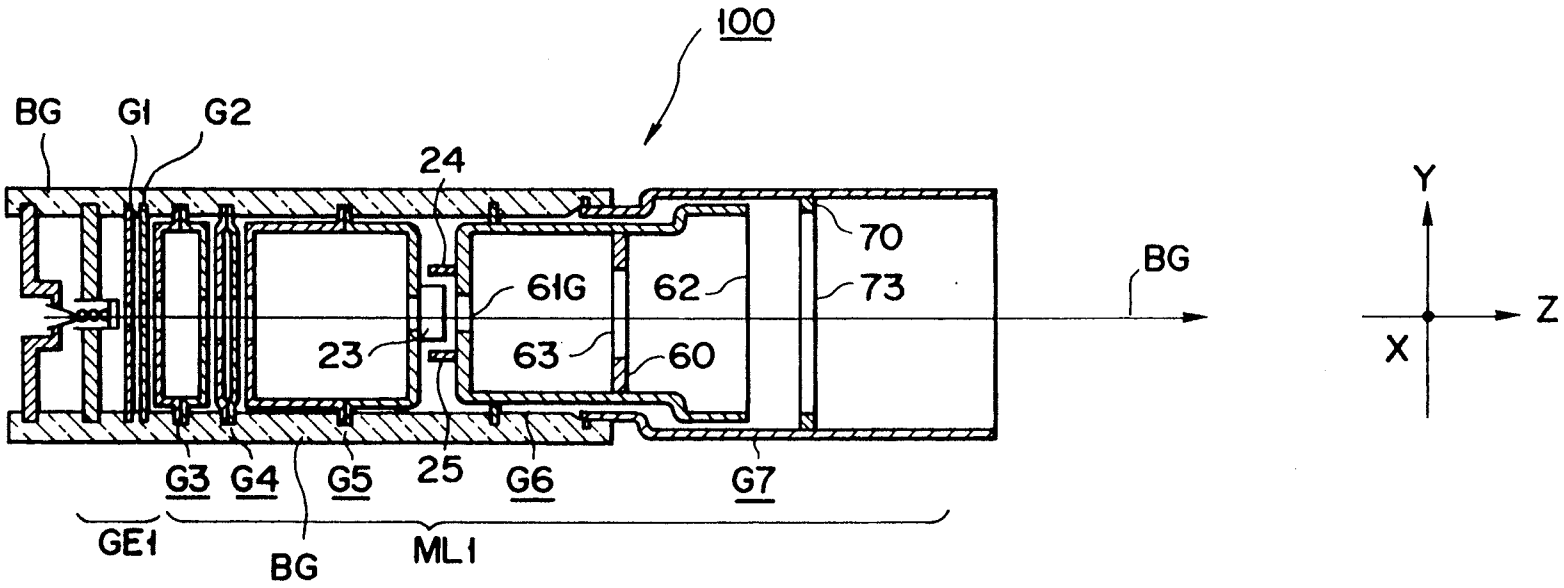
FIG. 5 is a Y-Z sectional view schematically showing the electron gun assembly shown in FIG. 4.

FIG. 4 is a sectional view taken along the X-Z plane showing part of the neck and screen of the color cathode ray tube apparatus according to an embodiment of this invention. FIG. 5 is a sectional view taken along the Y-Z plane of the electron gun. In FIGS. 4 and 5, electron gun assembly 100 disposed in neck 5 comprises cathodes K, first grid G1, second grid G2, third grid G3, fourth grid G4, fifth grid G5, sixth grid G6, seventh grid G7, insulating support member BG for supporting these grids and valve spacer 112. Electron gun 100 is fixed to stem pins 113 of the rear portion of the neck. Cathodes K each have a heater inside and generate three electron beams BR, BG and BB. The first and second grids G1 and G2 each have three relatively small beam-passing apertures corresponding to three cathodes K. These apertures serve to control and accelerate the electron beams generated by cathodes K. These cathodes K, the first and the second grids G1 and G2 constitute the so-called electron beam generating section GE. The third, fourth and fifth grids G3, G4 and G5 each have three relatively large beam-passing apertures corresponding to three cathodes K.

As shown in FIG. 4, four electrodes 20, 21, 22 and 23, extending perpendicularly to the direction of in-line arrangement (X-Z plane), are arranged in the in-line arrangement direction to hold therein three beam-passing apertures 52R, 52G and 52B on that side of the fifth grid G5 which faces the sixth grid G6. Referring to FIG. 5, the sixth grid G6 has two electrodes 24 and 25 extending in parallel with the in-line arrangement direction and has two electrodes 24 and 25 fixed on the side facing the fifth grid G5. Three beam-passing apertures 61R, 61G and 61B are formed in the side of the sixth grid G6 between the electrodes 24 and 25. FIG. 4 shows that the four electrodes 20, 21, 22 and 23 fixed on the fifth grid G5 are arranged between electrodes 24 and 25 of the sixth grid G6. When voltage is applied across the fifth grid G5 and the sixth grid G6, quadrupoles are formed between the four electrode plates of fifth grid G5 and the two electrode plates of the sixth grid G6.

Figure 6B:
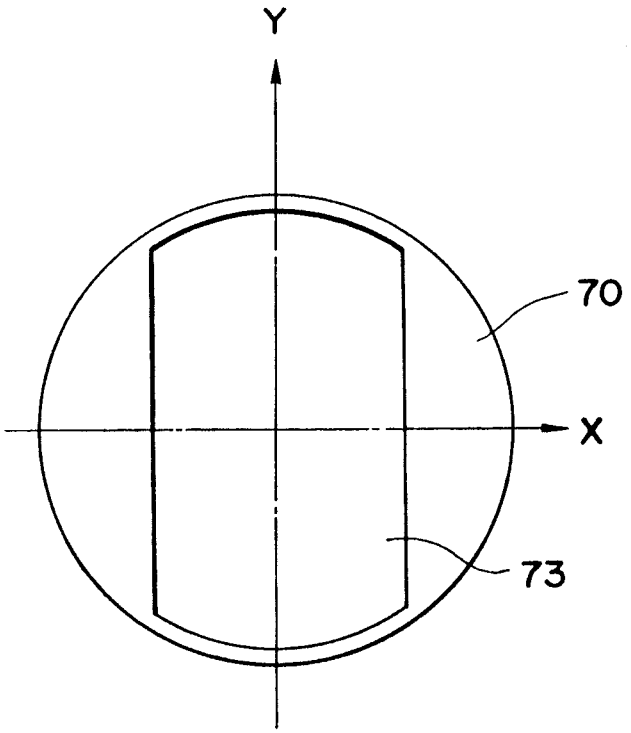
FIGS. 6A and 6B are views showing the construction of the electrode shown in FIG. 5.
Figure 6A:
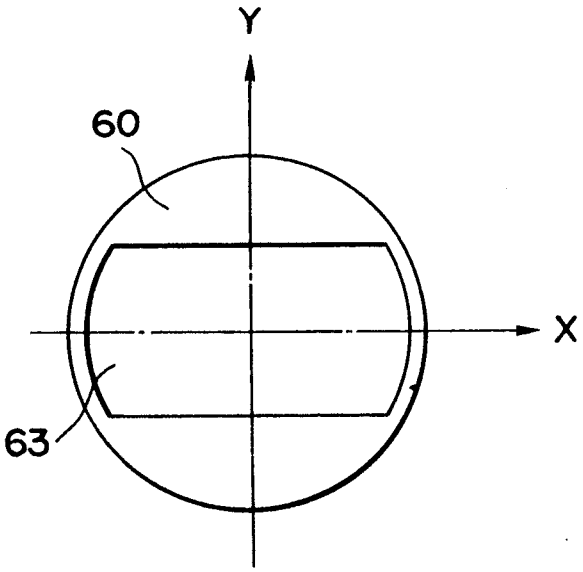

The sixth grid G6, which is a generally cup-shaped electrode, has formed on the side facing the fifth grid G5 three beam-passing apertures 61R, 61G and 61B generally identical in size with beam-passing apertures 52R, 52G and 52B of the fifth grid G5. The sixth grid G6 has formed on the side facing the seventh grid G7 a single large round aperture 62 to pass the beams therethrough. In this cup-shaped electrode and at the mid-point in the longitudinal direction thereof, there is electrode 60 having a racetrack-like beam-passing aperture 63 with its major axis in the in-line arrangement direction (X direction) as shown in FIG. 6A. This beam-passing aperture 63 is placed at a specified distance "a" from the end of the side of the sixth grid G6 closer to the seventh grid G7. The distance "a" is smaller than the diameter D6 of large round aperture 62.

The seventh grid G7 is generally a cylindrical electrode, and a part of the cylindrical sixth grid G6 is received therein. A large-diameter cylindrical lens is formed between the seventh grid G7 and round aperture 62 of sixth grid G6. Electrode 70 is provided in the cylindrical electrode of the seventh grid G7, placed at a specified distance "b" from the end of the sixth grid G6 towards the screen. Electrode 70 has therein a racetrack-like beam-passing aperture 73 with its minor axis in the in-line arrangement direction (X direction) as shown in FIG. 6B. The relation of the specified distance "b" to the cylinder diameter D7 of the seventh grid G7 is $b<D7$. In this embodiment, the distances "a" and "b" are selected to satisfy an inequality, $a>b$.

Valve spacer 112 is fixed to the outer periphery of the end of the seventh grid G7 as shown in FIG. 4 and is kept in contact with conductive film 10 applied to the inner surface of the tube from funnel 4 to neck. In this way, a high anode voltage is supplied from the anode terminal on the funnel through valve spacer 112 and conductive film 10 to the seventh grid G7. A magnetic field correction element for correcting the magnetic field produced by deflection yoke 7 may be disposed at the end of the seventh grid G7. Cathodes K and the seven grids G1 through G7 are supported by the insulating support member BG. Deflection yoke 7 is mounted surrounding neck 5 and funnel 4. Deflection yoke 7 comprises horizontal and vertical deflection coils for horizontal and vertical deflection of three electron beams BR, BG and BB from the electron gun. In addition, multipolar magnet 51 is disposed around neck 5.

In the electron gun, specified voltages are applied from outside through stem pins 113 to the electrodes except for the seventh grid G7. In the electrode arrangement as described, for example, a signal of cut-off voltage of about 150 V added with the video signal is applied to cathodes K, and first grid G1 is maintained at ground potential. The following voltages are applied to other grids: 500 V to 1 kV to the second grid G2, 5 to 10 kV to the third grid G3, 500 to 3 kV to the fourth grid G4, 5 to 10 kV, a slightly higher voltage than the voltage applied to the fifth grid, to the fifth grid G5, 5 to 10 kV to the sixth grid G6, and a high anode voltage of 25 to 35 kV to seventh grid G7.

Figures 7A, 7B, 8A, 8B:
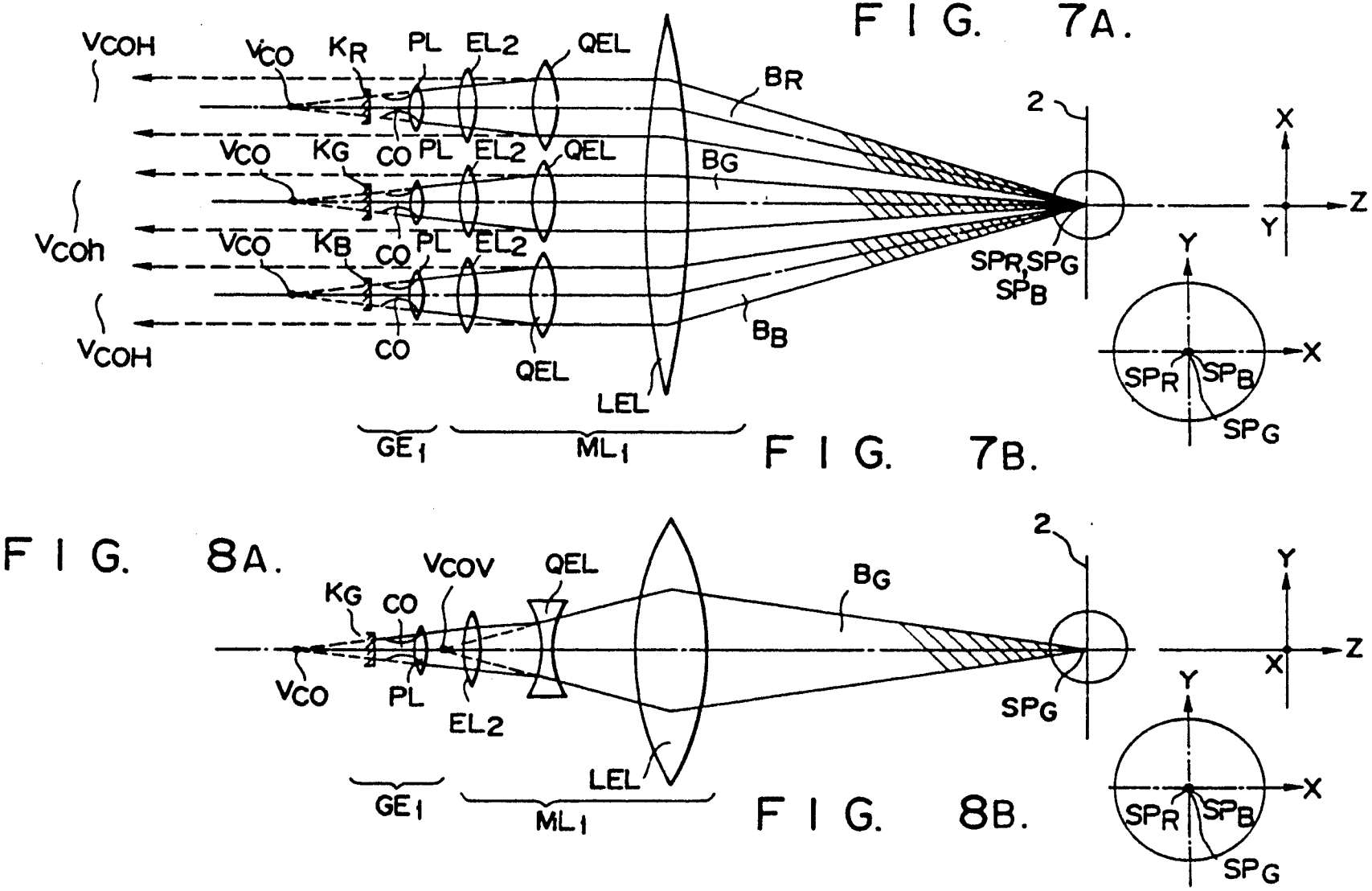
FIGS. 7A, 7B, 8A and 8B are schematic diagrams showing optical models in the electron gun shown in FIG. 4.

As the voltages are applied to the electrodes as described, the electron beams produced by the cathodes K, in response to modulation signals, form crossover CO as shown in FIG. 8 due to the cathodes K, the first grid G1 and the second grid G2. Therefore, the electron beam diverged at this crossover CO is slightly focused by the prefocus lens PL formed by the second grid G2 and the third grid G3. Therefore, the electron beam is made to form a virtual crossover point VCO by the prefocus lens PL, and the lens QEL so that the electron beam is seen as if it is produced at the crossover VCO corresponding to the image point of the crossover CO, diverged and incident on the third grid G3. The beams BR, BG and BB incident on third grid G3 are focused towards screen 2 and are also converged towards a point on screen 2 by the main electron lens ML1 formed by the third grid G3 to the seventh grid G7. Thus, the side beams are deflected by the convergence as described towards the center beam and to a common convergence point near the screen.

The function of the main electron lens from the third grid G3 to the seventh grid G7 will be described in greater detail with reference to the equivalent models shown in FIGS. 7A, 7B, 8A and 8B.

The electron beams diverged from the virtual crossover VCO and incident on the third grid G3 are slightly focused by the individual weak unipotential lens EL2 formed by the third grid G3, the fourth grid G4 and the fifth grid G5. As described earlier, the fifth grid G5 has four electrodes 20, 21, 22 and 23 arranged perpendicularly to the in-line arrangement direction (X-Z plane) and the sixth grid G6 has two electrodes 24 and 25 arranged in parallel with the in-line arrangement direction. Therefore, when voltage is applied across the fifth grid G5 and the sixth grid G6, quadrupole lens QEL is formed between these electrodes. The electron beams incident on this quadrupole lens are diverged more in the vertical direction than in the horizontal direction. The magnitude of the diverging power of the quadrupole lens QEL is set adequately according to the the distortion or the convergence of the beam spots formed on screen 2. To this end, the dimensions and the mutual spacing of the above-mentioned six electrodes 20, 21, 22, 23, 24 and 25 are selected appropriately. In this embodiment, it is desirable to form a quadrupole lens QEL so that the electron beam emerging from the quadrupole lens is diverged in the vertical direction and shaped in a generally parallel beam in the horizontal direction.

When the electron beam which has passed through such a quadrupole is incident on a large-diameter electron lens LEL, the electron beam, subjected to the action of the large-diameter lens, is finally converged near the screen and focused on the screen in an adequate manner.

Figure 9:
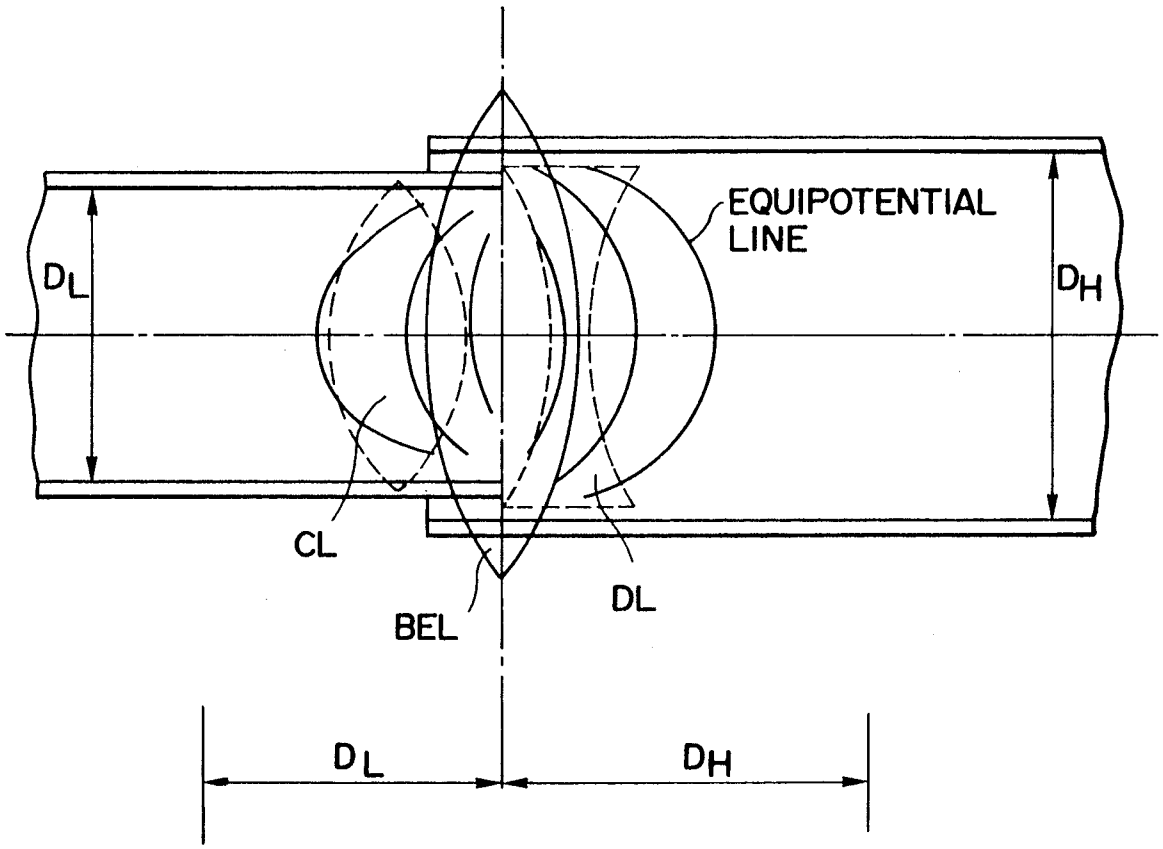
FIGS. 9 and 10 diagrams for explaining the arrangements of the large-diameter electron lens shown in FIGS. 7 and 8.

The reason why such good focusing and converging characteristics can be obtained will now be described with references to FIGS. 4 and 9.

The large-diameter electron lens section LEL is substantially a combination lens including a lens CL formed in the front stage and a lens DL formed in the rear stage. This combination lens is regarded as a large-diameter electron lens LEL. In other words, since horizontally long beam-passing aperture 63 is formed inside of the grid G6, the high-voltage electric field from the seventh grid G7 is distorted by beam-passing aperture 63 and the front-stage converging lens CL, having a weak focusing power in the horizontal (X) direction and a strong focusing power in the vertical (Y) direction, is formed near beam-passing aperture 63. On the other hand, since a vertically long beam-passing aperture 73 is formed inside of the sixth grid G7, the low-voltage electric field is distorted by the beam-passing aperture 73, and a rear-stage diverging lens DL having a strong diverging power in the horizontal (X) direction and a weak diverging power in the vertical (Y) direction is formed near the beam-passing aperture 73. A combination lens composed of the focusing lens CL and the diverging lens DL has a weak focusing power in the horizontal (X) direction and a strong focusing power in the vertical (Y) direction and therefore corresponds to a single large-diameter asymmetric lens.

Figure 1:
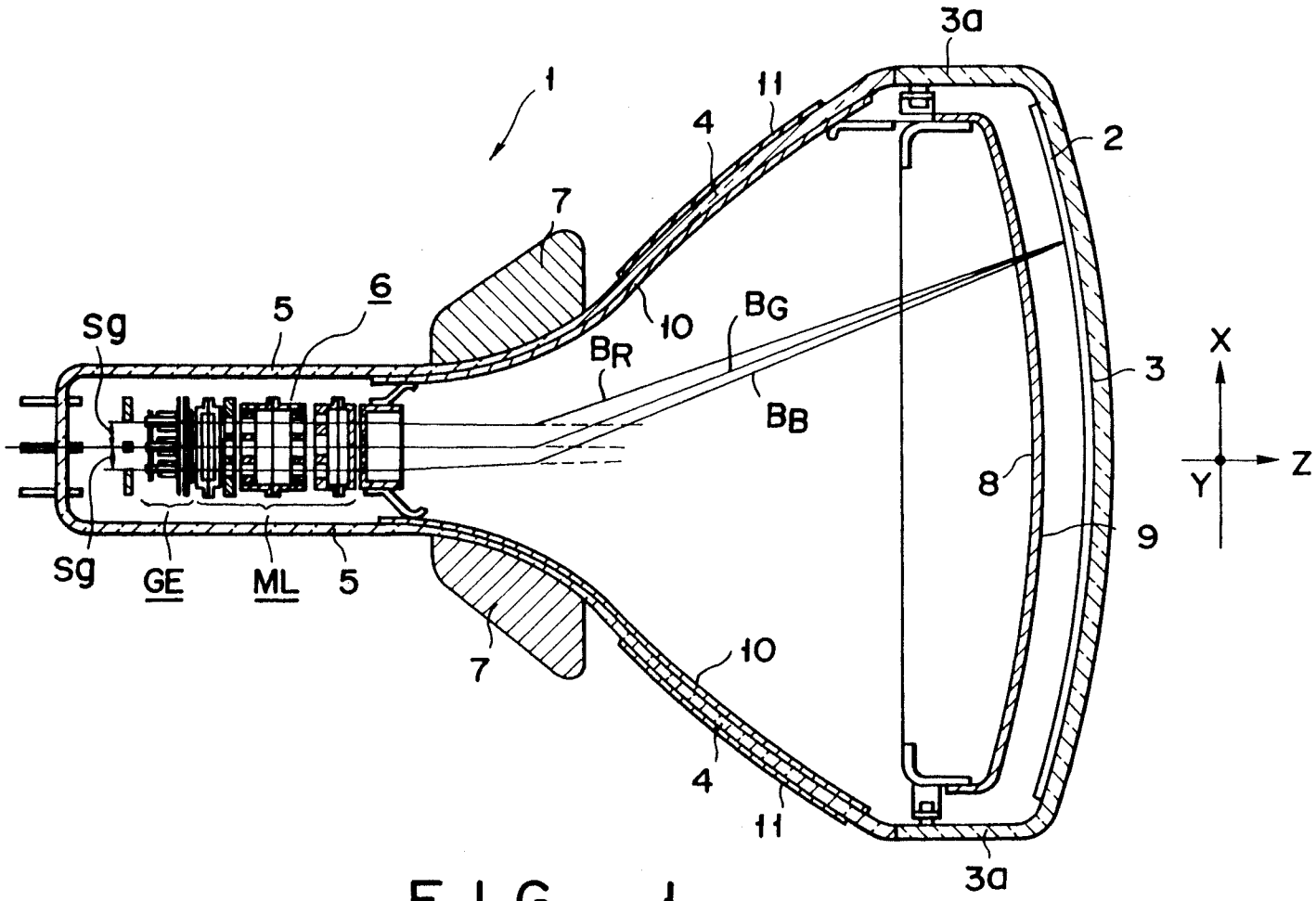
FIG. 1 is a longitudinal sectional view showing a conventional color cathode ray tube apparatus.
Figure 2:
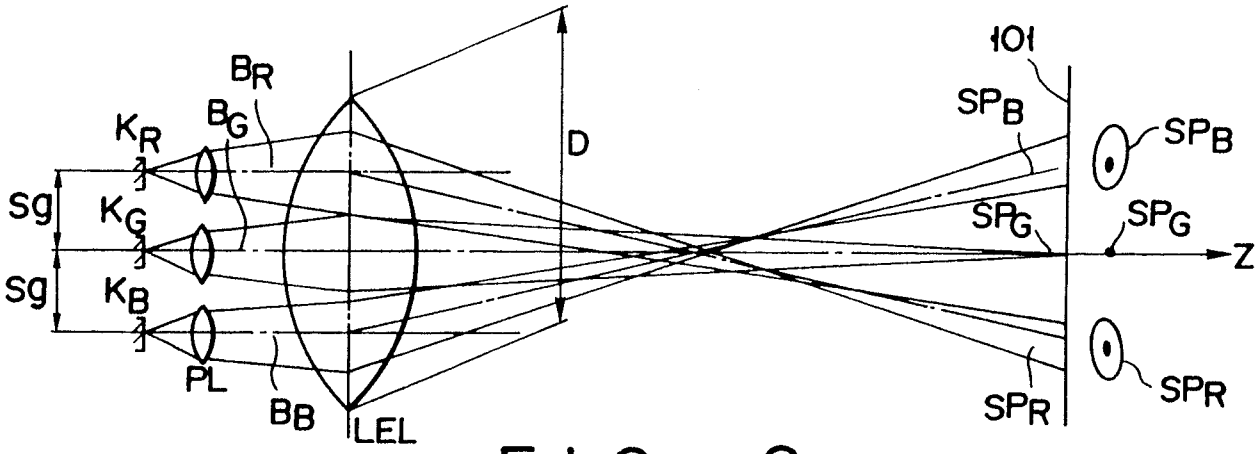
FIGS. 2 and 3 are schematic diagrams showing optical models in conventional electron gun assemblies.
Figure 3:
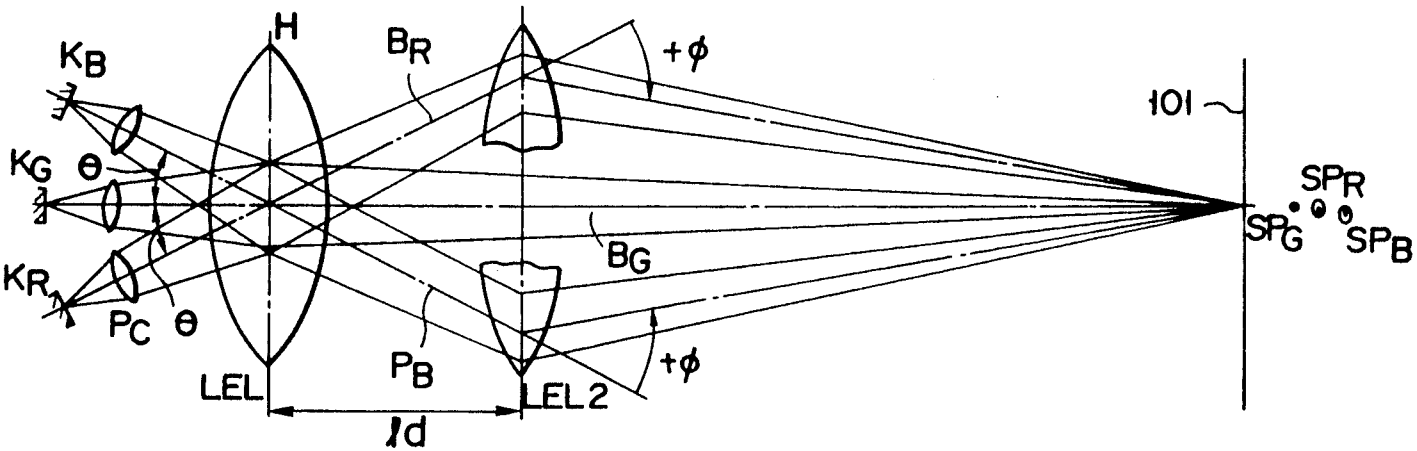

Description will now be made of the converging and focusing characteristics in this embodiment. Referring first to the converging characteristics, three electron beams which are incident on a single large-diameter lens LEL have their axes parallel with one another. Therefore, the electron beams are subjected to a weak converging power of the large-diameter lens LEL in the horizontal direction and are converged adequately on the screen. If the single large-diameter lens LEL has a strong converging power in the horizontal direction as shown in FIG. 2, the electron beams show converging characteristics in which the electron beams are over-converged on the screen. Referring next to the electron beam focusing characteristics, the electron beams passing through the quadrupole lens QEL are slightly affected by the horizontal focusing action as they pass therethrough and diverged in the vertical direction. By the large-diameter lens LEL, the electron beams are affected slightly by the focusing action in the horizontal direction but subjected a strong focusing action in the vertical direction and therefore are focused on the screen in an adequate shape.

The unipotential lenses EL2 formed between the grids G3, G4 and G5 as disclosed in this embodiment serve to adjust the diameters of the beams which are incident on the large-diameter electron lens LEL and also control the converging condition of the electron beams for the whole of the main electron lens ML1 including the unipotential lenses and the single large-diameter lens LEL. In this embodiment, the lens EL2 provided outside the lens zone of the large-diameter electron lens LEL may be an asymmetric lens. If the second electron lens that provides a weak focusing action is disregarded here for simplicity of explanation, the beams emerge from the virtual crossover point VCO on the optical axis focused by the asymmetric lens QEL to such an extent that the beams are generally parallel with the respective beam, axes in the horizontal direction and as a result, the virtual crossover point VCOH in the horizontal direction is formed infinitely backwards a point at from the cathodes.

Therefore, the three horizontally in-line beams are converged by the large-diameter electron lens LEL on the screen; and the beams are focused on the screen. This means that the focus on the image point of the large-diameter electron lens in the horizontal direction is on the screen. In actuality, however, the power of the lenses QEL and LEL need to be adjusted for the spherical aberration of the lens and the emittance of the beams emitted from the cathodes. On the other hand, since the beams are diverged or weakly focused by the asymmetric lens QEL in the vertical direction, the virtual crossover point VCOV in the vertical direction is located closer to the screen far more than the VCOH in the horizontal direction and the beams are focused strongly by the large-diameter electron lens on the screen.

Therefore, the three in-line electron beams are converged and also focused in a round spot on the screen.

The values of the preferred embodiment described above are set, for example, as follows:

Cathode spacing: Sg=4.92

Aperture diameters of electrodes:

G1ϕ, G2ϕ=0.62

G3ϕ, G4ϕ, G5ϕ, G6ϕ=4.52

G6Tϕ=D6=25.0

G7=D7=28.0

$$\text{Electrode (26)} = \begin{cases} X & 23.0 \\ Y & 8.0 \end{cases}$$

$$\text{Electrode (27)} = \begin{cases} X & 14.0 \\ Y & 26.0 \end{cases}$$

Lengths of electrodes:

G3=6.2

G4=2.0

G5=35.0

G6=30.0

Electrodes (20) to (23)=4

Electrodes (24), (25)=4

Spacing of electrodes:

G1/G2=0.35

G2/G3=1.2

G3/G4, G4/G5=0.6 a=11.0 b=6.0

Figure 10:
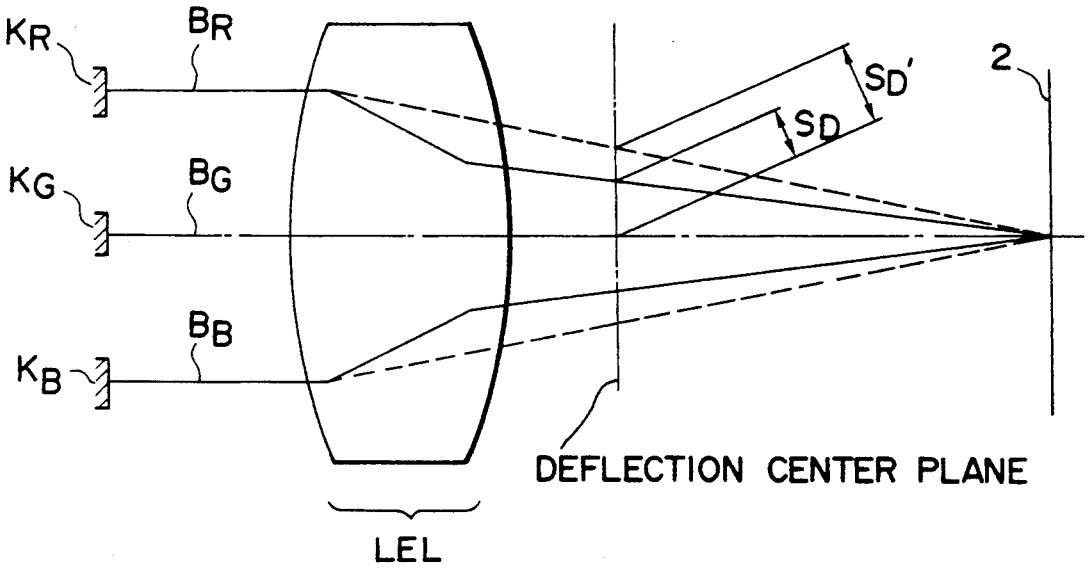

In this embodiment, the large-diameter electron lens LEL is formed to have a strong horizontal diverging power at the rear stage. Therefore, as shown in FIG. 10, the space SD on the deflection center plane of the three electron beams emerging from the large-diameter electron lens and converged on the screen is considerably smaller than the space SD' when the beams are simply converged as indicated by the dotted lines in FIG. 10. Consequently, the convergence error when the three beams are deflected on the whole area of the screen can be reduced and the required electric power for deflection can be decreased. As a result, it is possible to provide a color cathode ray tube apparatus of high video resolution and high quality.

In the above-described embodiment, when deflection yoke 7 generates a convergence free magnetic field, the beam spot distortion caused by the magnetic deflection field increases. However, as the voltage of the fifth grid G5 is varied synchronously with the horizontal and vertical deflection of the beams, the power of the above-mentioned asymmetric lens QEL is also changed in synchronously with the the horizontal and vertical deflection of the beams. In this manner, the deflection distortions can be canceled out. In addition, the magnetic deflection field formed by deflection yoke 7 may be a uniform field to prevent the beams from being distorted, and a good convergence may be achieved by controlling the relation between the video signal and the deflecting current.

In the above-described embodiment, a bipotential type cylindrical lens for use as a common large-diameter asymmetric electron lens is formed; a horizontally long beam-passing aperture 63 is provided at a distance "a" away from the end of the grid G6; and a vertically long beam-passing aperture 50 is provided at a distance "b" away from the end of the grid G6, thereby strengthening the horizontal diverging action of the lens DL formed at the rear stage to comply with the relation of $a>b$. This invention is not limited to this arrangement, but a common large-diameter asymmetric lens can be formed when $a=b$ or $a<b$. And, the horizontally long beam-passing aperture at the front stage may not be provided. Needless to say, the noncircular beam-passing apertures may be modified adequately as long as the large-diameter asymmetric lens has a stronger focusing power in the vertical direction than in the horizontal direction.

It is of course possible to use a unipotential type lens or an extended electric field type lens other than the bipotential type cylindrical lens. In the above embodiment, the asymmetric lens QEL is provided between the fifth grid G5 and the sixth grid G6 so that the three separate beams incident on the common large-diameter asymmetric lens LEL are generally parallel in the horizontal cross section and are diverged in the vertical cross section. However, this invention is not limited to this arrangement and, as mentioned above, it is possible to form an asymmetric lens at the fourth grid G4 or at the electron beam generating section to make the individual beams generally parallel in the cross section in the horizontal direction.

The cathode ray tube apparatus according to another embodiment of this invention will be described referring to FIGS. 11 and 12.

Figure 11:
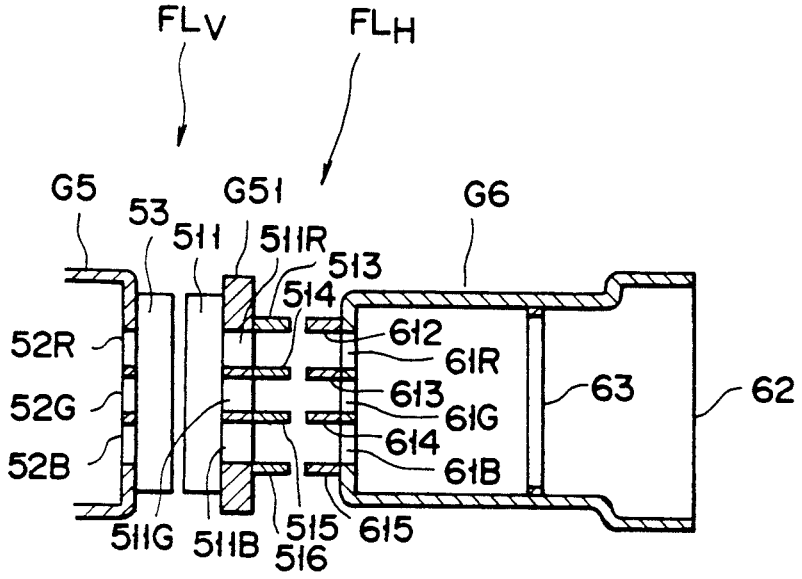
FIGS. 11 and 12 are schematic sectional views showing the electrode construction for forming the large-diameter asymmetric lens according another embodiment of the invention.
Figure 12:
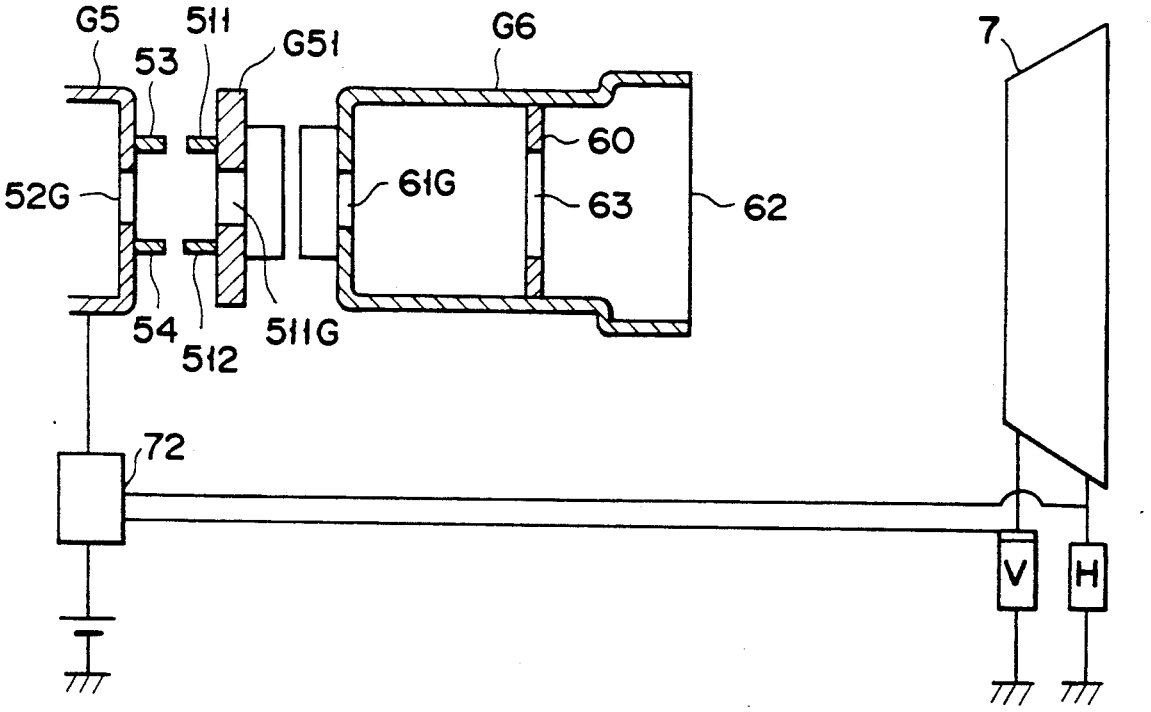

FIGS. 11 and 12 show the X-Z cross section and the Y-Z cross section corresponding respectively to FIGS. 4 and 5. The corresponding parts and positions bear corresponding reference numerals and will not be described here.

As shown in FIG. 11, two electrode plates 53 and 54, which are located above and below the three beam-passing apertures 52R, 52G and 52B, are fixed to the end of the fifth grid G5. Likewise, two electrode plates 511 and 512, located above and below three beam-passing apertures 511R, 511G and 511B are fixed to the side of the additional grid G51 facing the fifth grid. Four electrode plates 513, 514, 515 and 516 are arranged in the upright position on the side of the additional grid G51 which faces the sixth grid G6. Likewise, four electrode plates 612, 613, 614 and 615 are arranged in the upright position to hold three beam-passing apertures 61R, 61G and 61B therebetween on the side of the sixth grid G6 which faces the grid G51. In the sixth and seventh grids G6 and G7, noncircular beam-passing aperture 63 is provided to form a large-diameter cylindrical lens just as in the above-described embodiment.

When the fifth gird G5, the additional grid G51, the sixth grid G6 and the seventh grid G7 are energized at increasingly higher voltages in that order, a parallel plate lens FLV is formed, between the opposing electrode plates of the fifth grid G5 and the additional grid G51, which does not have focusing power in the horizontal direction but has a focusing power only in the vertical direction. And, a parallel plate lens FLV is formed, between the opposing electrode plates, the additional grid G51, and the sixth grid G6, which does not have focusing power in the vertical direction but has a focusing power only in the horizontal direction.

With the arrangement described, the electron beams are strongly focused by the lens FLV and the lens FLH. The electron beams from the beam generating section GE are focused strongly in the horizontal direction to be generally parallel and focused slightly in the vertical direction. The beams, still diverged, are incident on the common large-diameter asymmetric lens LEL and the three beams are focused and converged on the screen by the large-diameter lens as in the above-described embodiment.

Figure 13A:
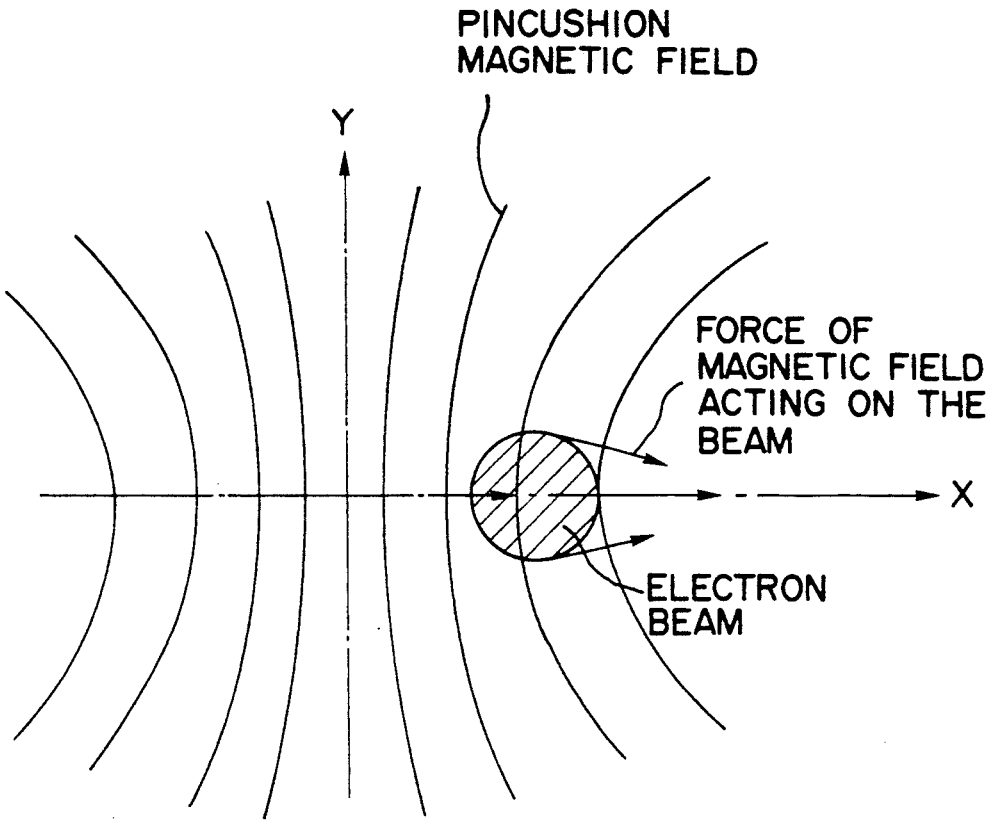
FIGS. 13A, 13B and 13C are views comparing the electron beam shapes in the color cathode ray tube apparatuses according to this invention and of the prior art.
Figures 13B, 13C:
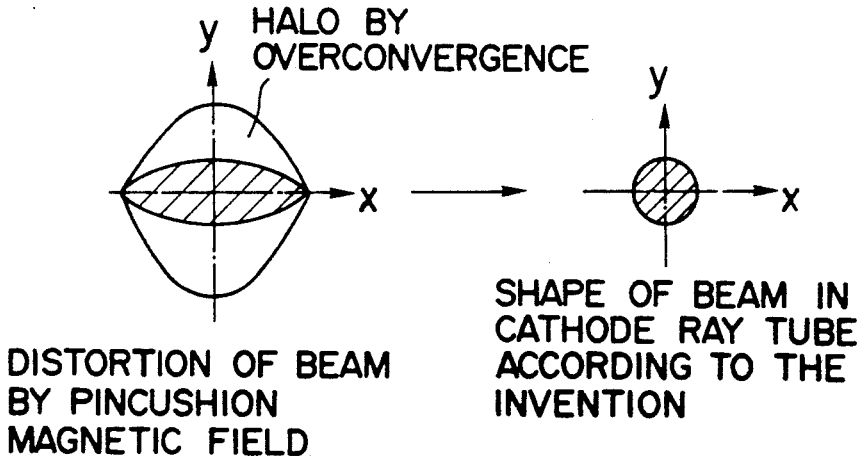

In this latter embodiment, dynamic correction circuit 72 is provided outside the tube and is connected to the fifth grid G5. A voltage signal, which varies synchronously with the horizontal and vertical currents H and V fed to deflection yoke 7, is supplied to the fifth grid G5. Generally, when the horizontal deflection magnetic field formed by the deflection yoke is shaped in the form of a strong pincushion magnetic field, the electron beam is overfocused strongly in the vertical direction by the pincushion magnetic field as shown in FIG. 13B when the beam is deflected to the peripheral portion of the screen as shown in FIG. 13A. In the cathode ray tube apparatus shown in FIGS. 11 and 12, however, the focusing by the electron lens FLV weakens synchronously with the horizontal and vertical deflection currents H and V and the focusing becomes insufficient in the vertical plane. Therefore, a round beam shape is formed as the deflection distortion in FIG. 13B is corrected as shown in FIG. 13C.

Figure 14:
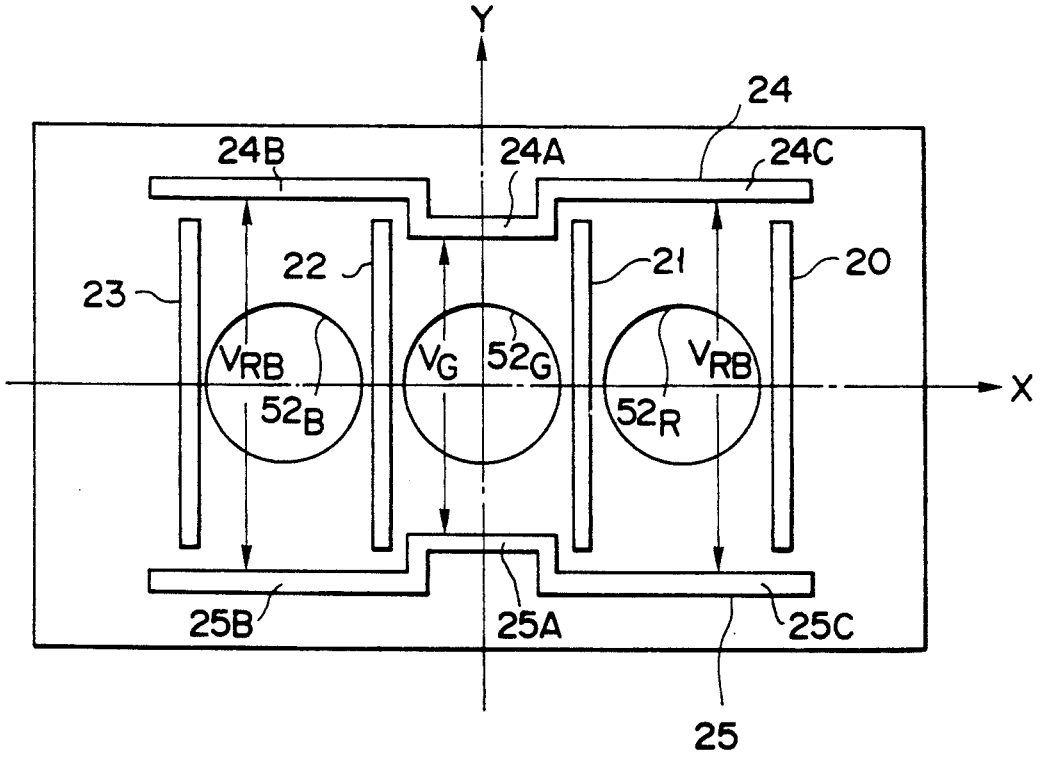
FIG. 14 is a sectional view schematically showing the electron gun construction of the color cathode ray tube apparatus according to another embodiment of this invention.

A color cathode ray tube apparatus according to a still another embodiment of this invention will be described. As shown in FIG. 14, two electrodes 24 and 25 are provided at the sixth grid G6. Two electrodes 24 and 25 have center sections 24A and 25A are separated by the distance Vg corresponding to the central beam-passing aperture 52C and side sections 24B, 24C, 25B and 25C on both sides of the center sections and are separated by the distance Vg corresponding to the side beam-passing apertures 52B and 52R. Therefore, a quadrupole lens QEL (G) formed for the center beam is provided with a stronger lens power than that of quadrupole lenses QEL (R) and QEL (B). In consequence, the center beam, which has been focused more strongly in the horizontal direction than the two side beams, are incident on the large-diameter electron lens LEL. When the electron beams which have passed through the quadrupole lens QEL are incident on the large-diameter electron lens as in the above-described embodiment, the beams are subjected to the action of the large-diameter lens and the beams reaching the screen show good converging and focusing characteristics.

In this invention, the lens performance is improved by arranging a common large-diameter asymmetric lens for the three separate beams in the main electron lens section. To achieve the convergence and focusing of the three beams simultaneously, the common large-diameter asymmetric electron lens is formed as an asymmetric lens having a focusing power which is weaker in the horizontal direction than in the vertical direction. The three separate electron beams which are incident on the common large-diameter asymmetric electron lens are formed by this lens into a generally parallel beam in the horizontal direction and also in a diverged beam in the vertical direction. The common large-diameter asymmetric electron lens comprises, for example, a common cylindrical electron lens for three electron beams emitted by the electron beam generating section. This cylindrical electron lens is formed by providing a noncircular beam-passing aperture for common passage of the three electron beams in this lens zone and, at least, at one of the cathode side and the screen side. Separate asymmetric electron lenses for the three beams are provided on the cathode side and outside the lens zone of the cylindrical electron lens. By using this electron lens, the beams are focused more in the horizontal direction, than in the vertical direction an thereby the beams generally parallel in the horizontal direction are obtained.

The noncircular beam-passing aperture on the cathode side in the lens zone of the above-mentioned cylindrical electron lens is substantially longer in the horizontal direction than in the vertical direction. The noncircular beam-passing aperture disposed on the screen side in the same lens zone is substantially shorter in the horizontal direction than in the vertical direction. It is possible to provide means for varying, according to the the amount of deflection by the deflection unit, the power of the separate asymmetric electron lenses for the three electron beams which are disposed on the cathode side outside the zone of the above-mentioned cylindrical electron lens.

As has been described, with a color cathode ray tube apparatus according to this invention, the performance of the common large-diameter electron lens can be utilized to the full extent, and three parallel electron beams generated by the cathodes can be focused on the screen in the optimum focused and converged condition.

Therefore, a very small beam spot can be realized on the screen, which makes it possible to provide a color cathode ray tube apparatus with improved picture image performance.

What is claimed is:

1. A cathode ray tube apparatus having an electron gun assembly including:

generating means for generating three in-line electron beams on a horizontal plane and controlling and accelerating the electron beams; and a single main electron lens system for focusing and converging the three electron beams from the generating means, said main electron lens system comprising a single and common large-diameter asymmetric electron lens having different electron lens power in horizontal and vertical directions, the three electron beams being incident on said asymmetric electron lens, each incident beam being more diverged in the vertical plane than in the horizontal plane and each incident beam being substantially parallel to other beams in the horizontal plane.

2. A cathode ray tube apparatus according to claim 1, wherein said generating means includes electron beam generating arrangements for generating, controlling and accelerating three electron beams, each arrangement comprising means for emitting electron beams and a prefocus lens for prefocusing the emitted electron beams.

3. A cathode ray tube apparatus according to claim 1, wherein the asymmetric electron lens converges, weakly and individually focuses the electron beams towards a point in the horizontal plane, and strongly focuses the electron beams more strongly in the vertical plane than in the horizontal plane.

4. A cathode ray tube apparatus having an electron gun assembly including:

generating means for generating three in-line electron beams on a horizontal plane and controlling and accelerating the electron beams;

a single main electron lens system for focusing and converting the three electron beams from the generating means, said main electron lens system comprising:

a single and common large-diameter asymmetric electron lens having different electron lens power in horizontal and vertical directions, the three electron beams being incident on said asymmetric electron lens, each incident beam being more diverged in the vertical plane than in the horizontal plane, and each incident beam being parallel to other beams in the horizontal plane, and additional electron lens means for aligning the three beams in a substantially single direction in the horizontal plane and for diverging each electron beams in the vertical plane.

5. A cathode ray tube apparatus according to claim 4, wherein the additional lens means substantially collimate the electron beam in the horizontal plane.

6. A cathode ray tube apparatus according to claim 4, wherein the additional lens means includes a quadrupole lens.

7. A cathode ray tube apparatus according to claim 4, further comprising means for deflecting the three electron beams generated from the electron gun assembly in the horizontal and vertical planes.

8. A cathode ray tube apparatus according to claim 7, further comprising an envelope to receive the electron gun assembly and phosphor layers formed on the envelope for emitting red, green and blue light rays when the three electron beams are landed thereon.

9. A cathode ray tube apparatus having an electron gun assembly including:

generating means for generating three in-line electron beams in a horizontal direction and for controlling and accelerating the electron beams; and a main electron lens system for focusing and converging the three electron beams from said generating means, said electron lens system comprising:

a first hollow cylindrical electrode structure having, on one open end, an end electrode with apertures, and on the other open end, a first plate electrode with a noncircular hole with a major axis along a horizontal plane perpendicular to said center electron beam, the first plane electrode being distinct and separate from the end electrode;

a second hollow cylindrical electrode structure, in which a part of the first hollow cylindrical electrode structure is inserted and in which a second plate electrode, with a noncircular hole with a major axis along vertical direction, is placed, the first cylindrical electrode structure being at a lower potential than the second cylindrical electrode structure.

10. A cathode ray tube apparatus according to claim 9, wherein said main electron lens system comprises an additional electrode structure for guiding the electron beams, in a direction substantially parallel to the electron beams, from said generating means to the corresponding apertures of the end plate electrode, each of the electron beams being guided into the corresponding apertures being more diverged in the vertical direction than the horizontal direction.

11. A cathode ray tube apparatus according to claim 10, wherein said additional electrode structure includes a pair of first parallel plate electrodes arranged in the horizontal direction and electrically connected to the first hollow cylindrical electrode structure, and two pairs of second parallel electrodes electrically connected to said generating means and arranged in a vertical direction.

12. A cathode ray tube apparatus according to claim 11, wherein the additional lens means includes two pairs of third parallel plate electrodes, arranged in the vertical direction and electrically connected to the first cylindrical electrode structure, for passing the electron beams between these opposing electrodes.

13. A cathode ray tube apparatus according to claim 9, wherein the generating means includes electron beam generating arrangement for generating, controlling and accelerating three electron beams, each arrangement comprising means for emitting electron beams and a prefocus lens for prefocusing the emitted electron beams.

14. A cathode ray tube apparatus according to claim 9, further comprising means for deflecting the three electron beams generated from the electron gun assembly in the horizontal and vertical planes.

15. A cathode ray tube apparatus according to claim 9, wherein the first plate electrode is disposed a distance "a" away from the opposite opening of the first cylindrical electrode structure and the second plate electrode is disposed a distance "b" away from the opposite opening of the second cylindrical electrode structure, the distance "b" being not greater than the distance "a".

16. A cathode ray tube apparatus having an electron gun assembly including:

generating means for generating three in-line electron beams on a horizontal plane and controlling and accelerating the electron beams;

a single main electron lens system for focusing and converging the three electron beams from the generating means, said main electron lens system comprising:

a single and common large-diameter asymmetric electron lens having different electron lens power in horizontal and vertical directions, the three electron beams being incident on said asymmetric electron lens, each incident beam being more diverged in the vertical plane than in the horizontal plane, and each incident beam being parallel to other beams in the horizontal plane, and additional electron lens means for aligning the three beams in a substantially single direction in the horizontal plane and for diverging each electron beams in the vertical plane, said additional electron lens means having a variable lens power; and means for deflecting the three electron beams generated from the electron gun assembly in the horizontal and vertical planes, the deflection means generating a convergence free magnetic field, wherein said variable lens power of said additional electron lens means controls the degree of divergence of the three electron beams according to degree of deflection by said deflection means.

* * * * *